United States Patent [19]

Facchini et al.

[11] Patent Number: 4,665,681

[45] Date of Patent: May 19, 1987

[54] APPARATUS FOR MOUNTING TRANSPARENT SLIDES

[75] Inventors: Edoardo Facchini; Ivo D. Ben, both of Azzano Decimo, Italy

[73] Assignee: Gregoris Photo Equipment s.n.c. di Giuseppe Gregoris & C., Azzano Decimo, Italy

[21] Appl. No.: 664,789

[22] Filed: Oct. 25, 1984

[30] Foreign Application Priority Data

Nov. 17, 1983 [IT] Italy ..... 83503 A/83

[51] Int. Cl.[4] ..... B65B 63/00

[52] U.S. Cl. ..... 53/520; 40/158 B; 53/900; 83/71; 226/24

[58] Field of Search ..... 156/64, 354, 70, 361, 156/108, 378, 290, 521; 83/71; 226/24; 40/158 B; 53/250, 492, 435, 520, 473, 381 R, 266 C

[56] References Cited

U.S. PATENT DOCUMENTS

| | | | |
|---|---|---|---|
| 3,521,423 | 7/1970 | Koeppe et al. | 53/381 R |
| 3,788,031 | 1/1974 | Florjancic | 53/520 |
| 3,992,243 | 11/1976 | Berggren et al. | 156/108 |
| 4,004,340 | 1/1977 | Urban | 53/266 C |
| 4,161,899 | 7/1979 | Strunc | 83/71 |
| 4,250,641 | 2/1981 | Thompson | 40/158 B |

*Primary Examiner*—John J. Gallagher
*Attorney, Agent, or Firm*—Leonard Bloom

[57] ABSTRACT

A method and machine for automatically or manually mounting photographic films in predetermined lengths into mounts mechanically openable at one side. The invention includes an operative unit automatized and controlled by microprocessor for checking the film feed by monitoring notches on the film. A toothless roller system advances the film and loads it into a mount. Cooperating cutting means and opening means simplify the operation. A three-way shifter shifts the film either upwardly for storage, downwardly for disposal or may be passive in which case film proceeds to mounting.

2 Claims, 6 Drawing Figures

APPARATUS FOR MOUNTING TRANSPARENT SLIDES

BACKGROUND OF THE INVENTION

The present invention relates to a method and machine for mounting film into mounts mechanically openable at one side.

In the present state of the art various methods and machines are known for framing photographic films in predetermined lengths, into mounts elastically openable at one side.

Reference is made to the following Italian prior art documents:

Pat. No. 724342 of May 21, 1964 (Gemuplast) entitled: "Slide mount", which provides elastic opening of the mount for inserting the film length by means of prearranged opposite pins;

Pat. No. 809611, of July 6, 1966, entitled: "Slide-bearing mount" as first continuation of the preceding patent.

Patent application No. 27933A/76 of Oct. 1, 1976 (Gemuplast), entitled: "Device for cutting strips of processed films in film lengths and for the successive framing of same into slide mounts", wherein the opening of the respective mounts is carried out by means of ledge and sliding notches of the mount on a guiding system.

Patent application No. 27652A/79 of Nov. 28, 1979 (Gemuplast), entitled: "Method for framing automatically a reversible film provided with marginal notches", wherein the previous system is better explained and also the feeding system is developed by means of lateral opposite notches.

Pat. No. 791185 of Mar. 3, 1967 (Gemuplast), entitled: "Method and apparatus for inserting the slides into the relative supporting frames", wherein a cutting station is provided.

Pat. No. 849929 of Oct. 2, 1968 (Gemuplast), entitled: "Method and device for widening the inserting slot into a slide mount", wherein the above described opening system of the mount for receiving the film like an envelope is further developed.

The disadvantages of these currently-used known embodiments consist essentially in that sprockets or ratchet gears are used. The feeding effectiveness of which depends on the quality of the perforation, and the spacing of the perforation. Further drawbacks consist of limitations the working speed due to retractable blades or pusher elements and in the absence of automatized means for discarding the excess lengths of film and allowing recovery of others.

The object of the present invention is to obviate said disadvantages.

SUMMARY OF THE INVENTION

The present invention according to the claims realizes a new method and apparatus for automatically mounting photographic films consisting of:

providing side notches on continuous films to be mounted, at constant pace, after possible assembling of separate films into a longer film strip;

using notch detecting means to detect and control the extent of feed;

using a first feeding film means, placed immediately upstream the cutting means, said first feeding means consisting of a pair of opposed rollers without teeth or sprockets;

using a film cutting means that mechanically corporates with a downstream mount holding means and is driven by a single motor;

using a loading means for automatically loading said slide mounts arranged in piles. Extracting said mounts from the bottom by the same feeding means which will operate transversally to the film feeding plane and normally to the feeding path;

using a hooking means by transverse longitudinal sliding within two elastically openable edges;

using a second film feeding means as an inserting means comprising a pair of opposed rollers with gripping sectors adapted to work on the free space within the window of the mount;

using in said inserting station, between the cutting station and the inserting station, a three-way shifting means capable of shifting automatically or manually, the cut off film lengths:

on the same feeding line for inserting into the mount;

over the feeding line for recovering the film lengths not to be framed;

under the feeding line for discarding the film lengths not to be framed and not to be recovered.

In the preferred embodiment of the invention the drive of the mechanical units is actuated by independent stepping motors coordinated and programmed by a microprocessor. The microprocessor is controlled in its turn by detecting means.

A further important advantageous feature of the invention is that said mount opening means and said film cutting means are mechanically moved by a single electric motor, allowing the following functions:

opening blades and mount simultaneously so as to allow insertion of a predetermined first portion of film into the mount;

simultaneous closing of the blades thus cutting the length of the partially inserted film;

successive final feeding of the cut film length for inserting thereof into the mount in final position by the said rotating second feeding means.

In a further preferred embodiment of the invention said orthogonal mount feeding means utilizes a connecting rod and crank motion system which allows the considerable advantage of increased working speed due to the fact that the alternate reciprocating movement for drawing the mounts from the bottom of the holder pile and feeding mounts to the inserting station starts gradually then ends gradually, thus reaching the maximum static and stall torques and at the same time minimum speed, suitable for soft thrusting of the mount and for precise positioning thereof.

In a further preferred embodiment of the invention said mount store consists of containing means comprising a number of aligned "mount holders", one adjacent the other, sliding on a carriage in a parallel longitudinal direction respective to the film feeding line.

In a further preferred embodiment of the invention each mount consists of two plates with central window, preassembled like a "small envelope" by heat welding. The edges are elastically openable for inserting the film. On the respective side edges of the window, two slightly raised guide paths elastically at the sides of the inserted film. This promotes the action of said second feeding means.

In a further preferred embodiment of the invention, said mount is outwardly provided on the edges with a raised lip. This reduces the friction associated with bringing the mount from storage to film inserting station.

The advantages offered by the invention are mainly that working speed is considerably increased, slide mount storing is increased, ejection from the line of the film advance is possible, thus allowing the recovery of film portions not desirable for mounting in upward direction and film portions suitable for disposal below the film advance line.

DESCRIPTION OF THE PREFERRED EMBODIMENTS

Figure 1:
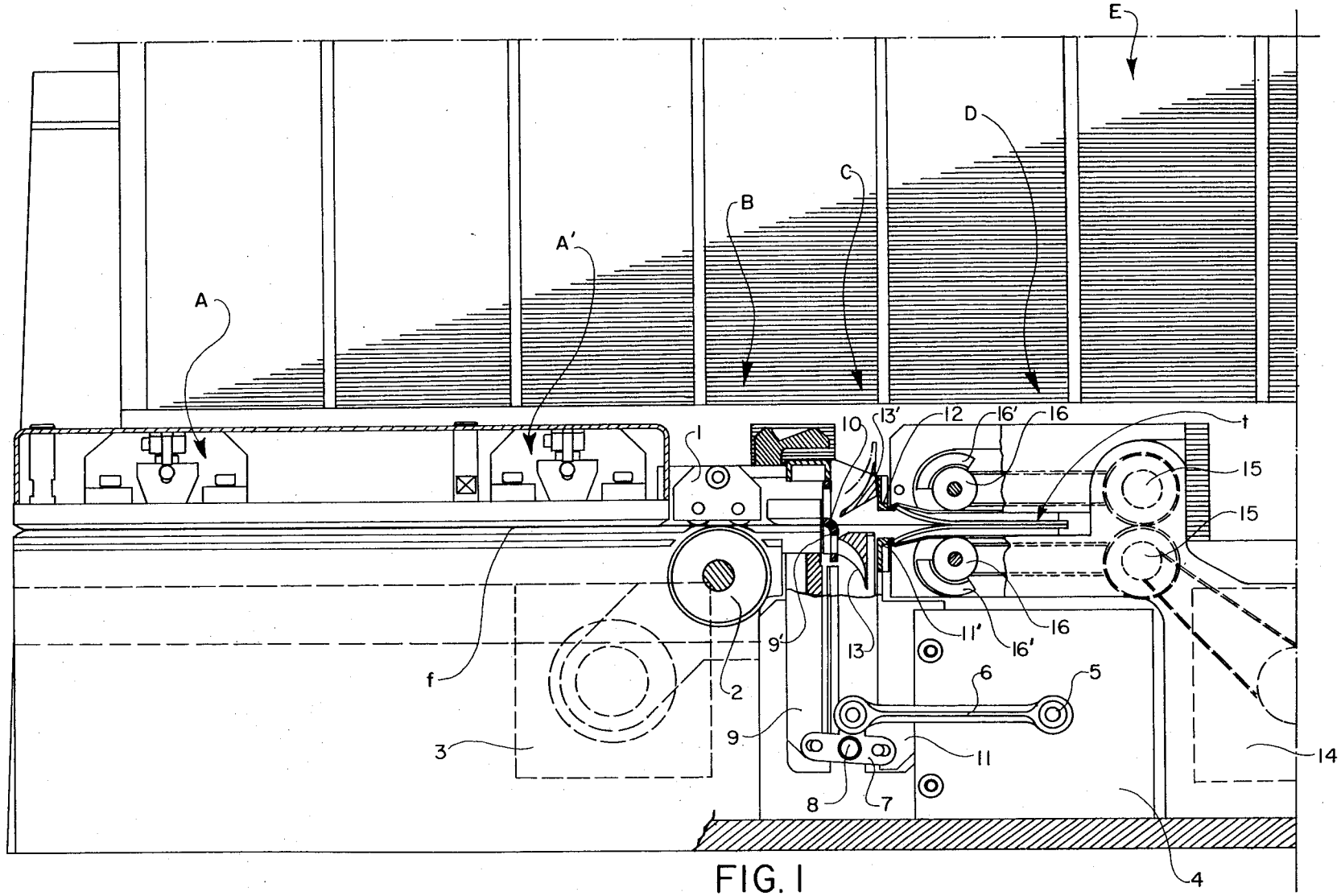
FIG. 1 is a partial front elevation view in partial axial section on the vertical plane passing through the film feeding path, of a mounting machine carried out according to the method of the present invention.
Figure 2:
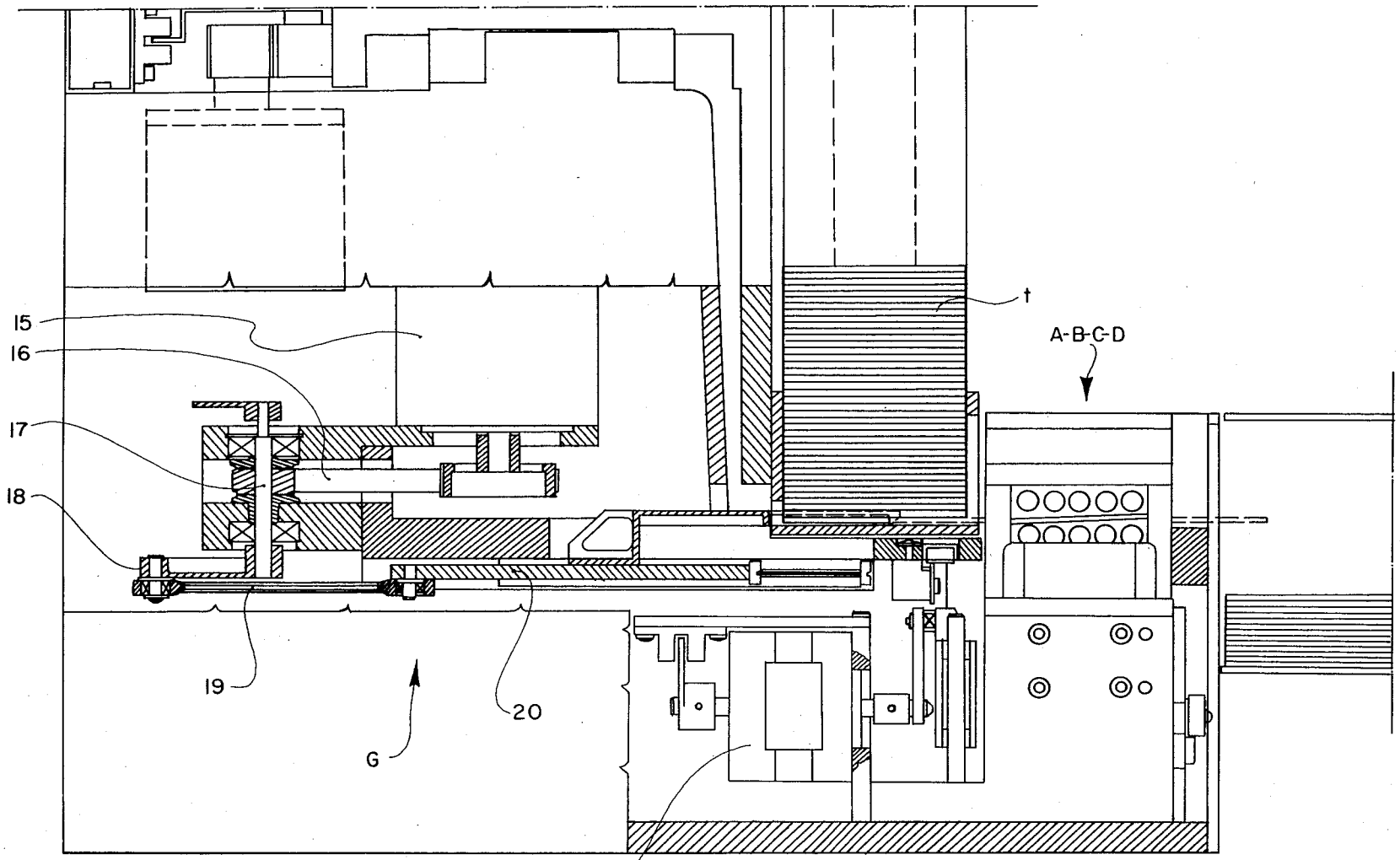
FIG. 2 is a side sectional view on the transverse plane passing through the mount feeding station.
Figure 3:
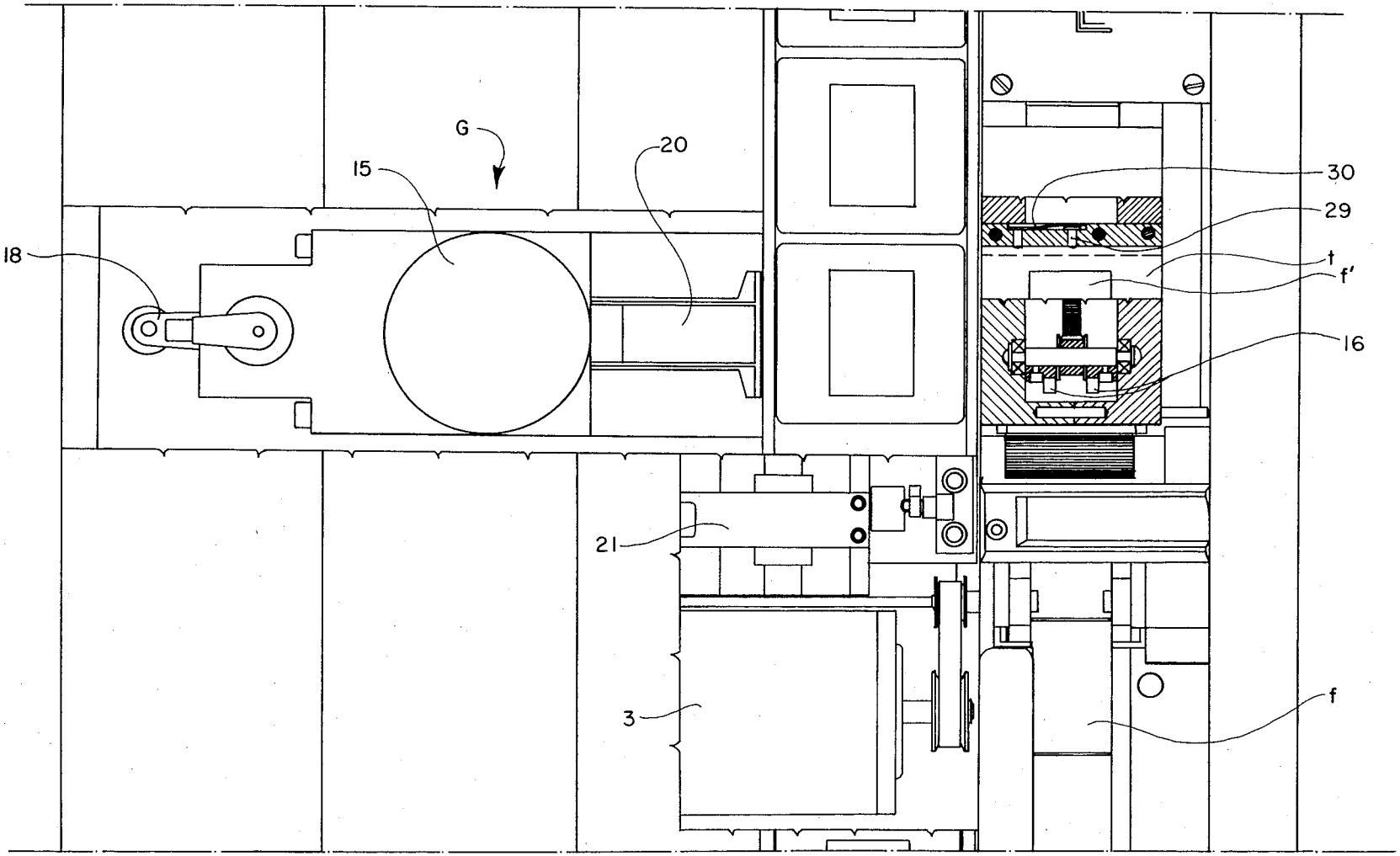
FIG. 3 is a plan view with section on the horizontal plane on the feeding path in correspondence with the axis of rotation of the segmented rollers of the second feeding device.
Figure 4:
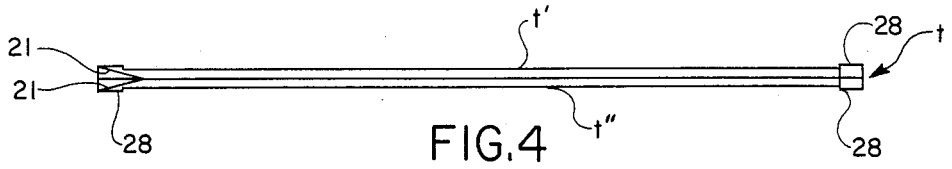
FIG. 4 is a side enlarged view of the slide mount.
Figure 5:
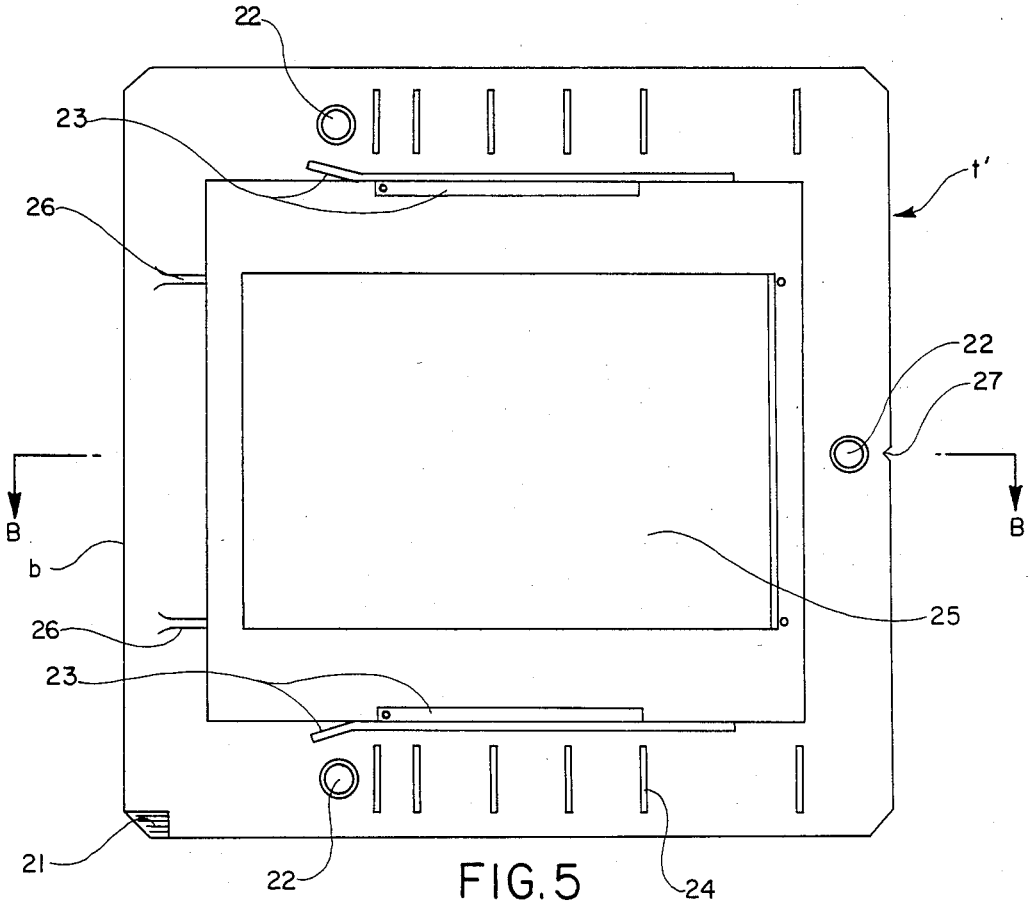
FIG. 5 is a top view of the inner face of one of the two plates forming the slide mount.
Figure 6:
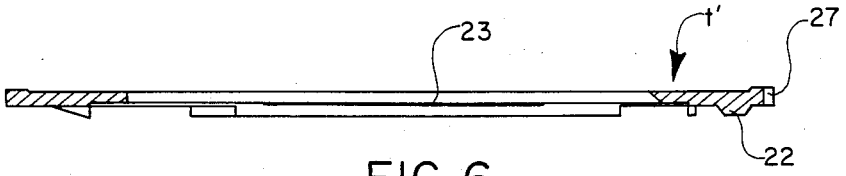
FIG. 6 is a sectional view on the transverse plane B—B of FIG. 5.

As shown in the above-mentioned figures, the invention consists utilizing a machine as shown in FIGS. 1, 2 and 3, with a slide mount as shown in FIGS. 4, 5 and 6.

More in detail, the machine comprises a feeding path for the film f, a notch detecting means A and a controlling means A' for microprocessor control of the film. FIG. 1 shows a first feeding means B, comprising a lower feeding roller 2 operated by a D.C. stepping motor 3 controlled by said controlling and checking means (a, A') and provided with a pair of opposite checking rollers mounted on an oscillating rocking lever 1. A central unit C constitutes the film inserting station, and comprises a cutting and opening station of the mounts t, operated by an independent stepping motor 4 which controls, by means of eccentric 5 and a connecting rod 6 a "T"-shaped transmission arm 7. A central pivot 8 is provided. The "T"-shaped arms move two hinged tie rods struts 9 and 11. The first strut moves the lower movable blade 9' which acts on the upper fixed blade 10. The second strut activates the lower movable 11' claw and a similar upper claw 12. They approach and move apart in opposite directions like the blades so that when the claws 11' and 12 are nearly closed a mount t can be inserted within them. When the claws are open, so are the blades.

A shifting station between the two preceding stations has a three-way shifter provided with two shifting opening guides 13 and 13'. The guides are vertically movable for alternately passing the film toward the mouth of the mount, shifting the film upwards for storage; or shifting the film f downwards for disposal. This control is actuated by an independent stepping motor 21'.

A second feeding means D is also controlled by an independent stepping motor 14 by means of transmission pulleys 15 controlling a respective pair of opposite advancing rollers 16 provided with friction grip segments 16'. The segments as they rotate within the respective windows of the mount subject first to insertion of the film. A store with a number of aligned mount holders E for feeding the mounts from the mount holders to the inserting station C. The loading means (as seen in FIG. 2) is an independently controlled stepping motor 15 which by transmission 16 and 17 actuates a connecting rod and crank system 19 and 18 which moves a transfer slide 20 passing under a respective magazine for drawing from the bottom and transferring in well-known manner one mount at a time into the inserting station. This is coordinated with the gripping claws for opening (11', 12).

As seen in FIGS. 4–6 each mount consists of two plastic plates t' and t provided with central window for viewing the slide scene. They are assembled one against the other with the aid of the three opposite self-centering tapered pins 22. Heat welding is used at different pitches 24 in order to make the opening edge b sufficiently free to be opened by the two gripping and opening claws. For this purpose the welding sections 24 are a little rearward with respect to the opening side and progressively closer for better resistance.

In order to facilitate insertion of said opening claws (9', 10), an opposite bevel 21 is provided on the inserting corner of the opening edges.

At the two opposite sides of the central window 25, respective pressure slides 23 are provided for keeping the inserted film length f' in fixed position.

Similarly, pairs of end ribs are provided acting as external othogonal sides 28 for facilitating transverse sliding during loading of the mount t.

On the inner surface of at least one plate t' of each mount, at the inserting side b and before the window 25, herringbone teeth 26 are provided for avoiding expulsion of the inserted film length.

The film inserting direction into the mount t is indicated by the large arrow in FIG. 5.

At the back side opposite to the edges of the mouth b of the mount t, a median "V" notch or similar recess is provided centrally for facilitating self-centering of the mount along the inserting path. A pin for checking position 29 is actuated by an elastic pressure spring 30.

The present invention may be embodied in other specific forms without departing from the spirit and scope thereof, and it is therefore desired that the present embodiments be considered in all respects as illustrative and not restrictive, reference being made to the appended claims rather than to the foregoing description to indicate the scope of the invention.

We claim:

1. An apparatus for making slides from film and mounts having openings, wherein the film has notches at predetermined locations, said apparatus comprising:

a linear film path;

a first film feeding means further comprising a smooth lower feed roller and two smooth checking rollers mounted on a rocking lever;

a film cutting and mount opening station comprising a microprocessor controlled stepping motor adapted to rotate an eccentric, a connecting rod mounted to the eccentric, a "T" shaped rocker transmission having a central pivot and two arms, first and second reciprocating tie rod struts pivotably attached to said arms, cooperating upper and lower reciprocating blades adapted to be driven by the first tie rod strut, cooperating upper and lower claws adapted to be driven by the second tie rod strut, means for coordinating the simultaneous opening and closing of the blades and the claws;

a second film feeding means comprising upper and lower friction rollers adapted to make contact with and advance the film into its terminal position through the mount opening; and a film shifting station located between the first and second feeding means comprising a central passageway, an upper guide, a lower guide, means for selectively engaging the upper guide and lowering it into the film path, and means for selectively engaging the lower guide and raising it into the film path; and film notch detecting means for detecting the extent of film feed; and means for controlling the extent of film feed.

2. An apparatus for making slides from film and mounts having openings, wherein the film has notches at predetermined locations, said apparatus comprising:

a linear film path;

a first film feeding means further comprising a smooth lower feed roller and two smooth checking rollers mounted on a rocking lever;

a film cutting and mount opening station comprising cooperating upper and lower reciprocating blades, cooperating upper and lower claws, and microprocessor controlled means for coordinating the simultaneous opening and closing of said blades and said claws;

a second film feeding means comprising upper and lower friction rollers adapted to make contact with and advance the film into its terminal position through the mount opening;

a film shifting station located between the first and second feeding means comprising a central passageway, an upper guide, a lower guide, means for selectively engaging the upper guide and lowering it into the film path, and means for selectively engaging the lower guide and raising it into the film path;

film notch detecting means for detecting the extent of film feed; and means for controlling the extent of film feed.

* * * * *